US005865128A

United States Patent [19]

Tarnay

[11] Patent Number: 5,865,128

[45] Date of Patent: Feb. 2, 1999

[54] FOLDING LEG MECHANISM

[75] Inventor: Matt Tarnay, Manhattan Beach, Calif.

[73] Assignee: Virco Mfg. Corporation, Torrance, Calif.

[21] Appl. No.: 896,318

[22] Filed: Jun. 25, 1997

[51] Int. Cl.[6] ..... A47B 3/00

[52] U.S. Cl. ..... 108/133; 108/131

[58] Field of Search ..... 108/129, 130, 108/131, 132, 133; 248/188.6, 188.91, 188.8

[56] References Cited

U.S. PATENT DOCUMENTS

| | | | |
|---|---|---|---|
| 1,057,545 | 4/1913 | Griffin | 108/133 |
| 2,278,810 | 4/1942 | Virtue et al. | 108/131 |
| 2,689,158 | 9/1954 | Mahr | 108/131 |
| 2,882,109 | 4/1959 | Eves et al. | 108/132 |
| 3,072,451 | 1/1963 | Greenberg et al. | 108/132 |
| 3,606,846 | 9/1971 | Andrews et al. | 108/132 |

*Primary Examiner*—Peter M. Cuomo
*Assistant Examiner*—Gerald A. Anderson
*Attorney, Agent, or Firm*—James E. Brunton

[57] ABSTRACT

A folding leg mechanism for use in foldably interconnecting a foldable leg assembly with a support platform such as a table top. The mechanism includes platform engaging links; a platform engaging plate pivotally connected to the first and second links proximate the ends thereof; and first and second spaced-apart, leg-engaging links pivotally connected to the platform engaging links and to the leg assembly. Each of the leg engaging links has a rod receiving slot formed therein which includes a channel portion, a ramp portion located proximate one end of the channel portion and a locking opening disposed proximate the ramp portion. A locking rod extends between the platform engaging links with the end portion of the rod being slidably received within the channel portion of the slot formed in the leg engaging links. When the rod resides within the locking opening, the platform engaging links and the leg engaging links are locked against relative pivotal movement. However, when the locking rod is lifted slightly, the rod ends move into the channel portion of the slot permitting free pivotal movement of the cooperating links.

20 Claims, 10 Drawing Sheets

FIG. 8
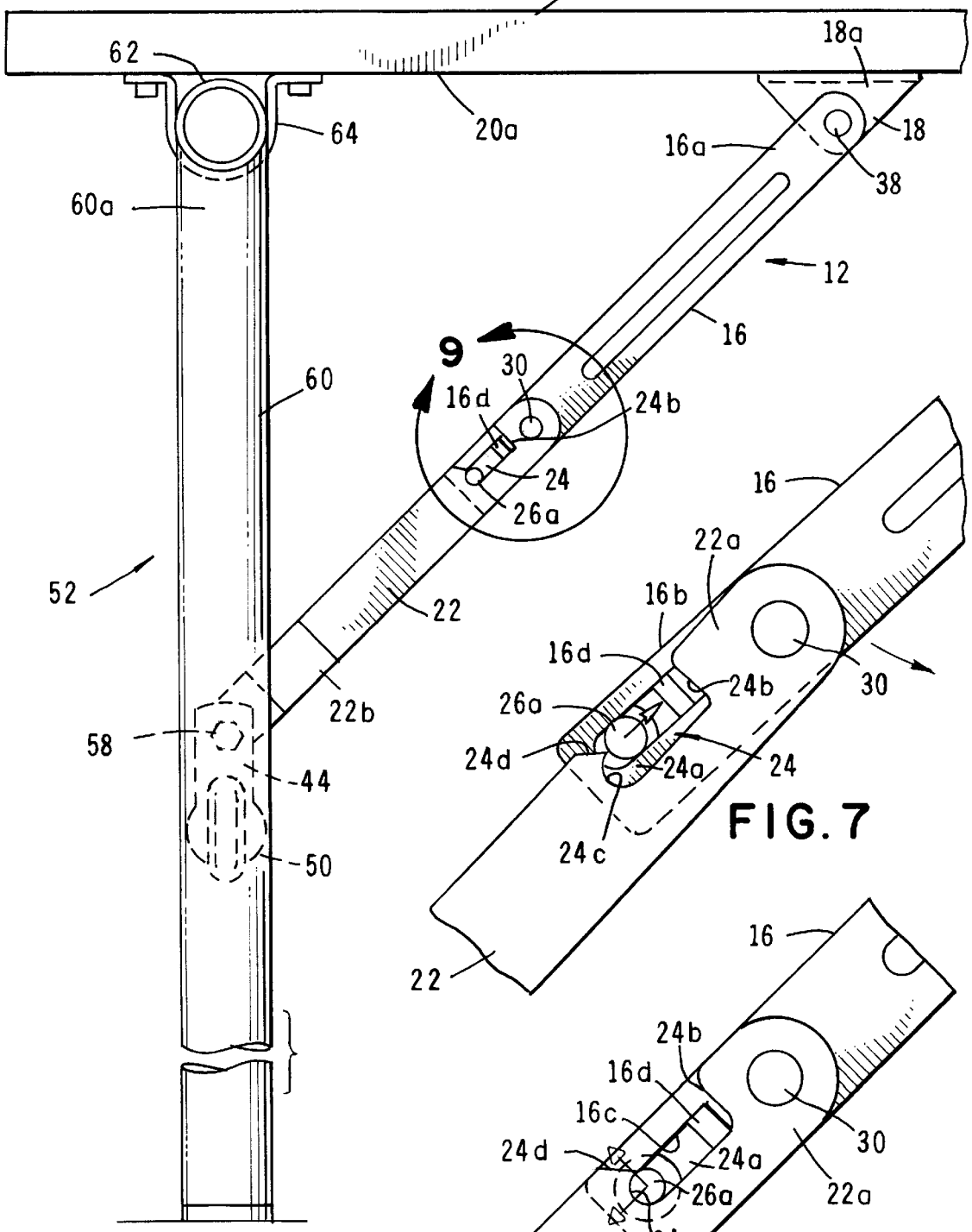
FIG. 7
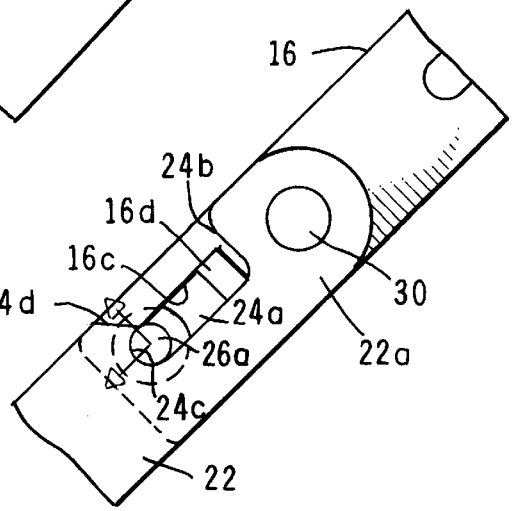
FIG. 9

FOLDING LEG MECHANISM

BACKGROUND OF THE INVENTION

1. Field of the Invention

The present invention relates generally to furniture. More particularly, the invention concerns a novel folding leg mechanism for use in connecting folding legs to table tops and the like.

2. Discussion of the Prior Art

Folding leg mechanisms of various designs for connecting folding legs to support platforms, such as table tops have been suggested in the past. Typically, these mechanisms comprise one or more pairs of pivotally interconnected links with one of the links being connected to the support platform and the other being connected to the folding legs.

Folding leg mechanisms for larger tables such as banquet tables generally rely on gravity type locking devices to prevent accidental collapse of the linkage when the table is in the operable, upright position. These devices usually comprise round or rectangular shaped metal tubes that capture the linkage at the pivot point to restrain it from collapsing. These devices are effective as locks but are cumbersome in use and are difficult to disengage to enable the legs to be folded into a stored position. As a rule, such locking sleeve type devices must be manually moved away from the pivot location before the linkage can be folded for storage. If the locking sleeve is not positioned correctly with respect to the pivot point, the linkage tends to bind against the restraint device when the leg is being folded. In operating the prior art folding leg mechanisms, the user generally grasps the leg itself to move it toward the folded position. However, in so doing the leg acts as a lever tending to further force the locking device into a binding condition thereby exposing the linkage and the leg to permanent damage. It is one object of the present invention to eliminate the foregoing problem by providing a locking mechanism which is very easy to move into a disengagement position, while at the same time providing a positive means for preventing accidental collapse of the mechanism when the legs which support the work platform are in an extended, operable position.

More particularly, one form of the folding leg mechanism of the invention comprises a transversely extending rod, the ends of which reside within a uniquely configured slot formed in the leg engaging links of a pair of links that interconnect with the folding legs of the table. With this novel construction, as the linkage is moved into the locking configuration, the rod moves either by force of gravity or by the urging of a specially designed spring member into an arcuate-shaped, keyhole-like end portion of the slot which lockably receives the ends of the rod. In order to release the locking mechanism, the rod need only to be moved upwardly a short distance so that the ends thereof move from the keyhole-like end portion of the slot into the channel shaped portion of the slot. With the locking rod in this disengagement position, free movement of the table legs toward their folded configuration can be accomplished without any risk of binding the linkage. More particularly, due to the unique configuration of the slot, the rod ends are at all times either within the keyhole-like portion of the slot or are within the open channel-like portion of the slot and, therefore, can never be in a position that will cause undesirable binding of the linkage as the table legs are moved toward the stowed position.

SUMMARY OF THE INVENTION

By way of summary, one form of the folding leg mechanism of the invention for use in foldably interconnecting folding legs with a support platform comprises first and second spaced-apart platform engaging links; a platform engaging plate pivotally connected to the first and second links proximate the ends thereof; and first and second spaced-apart leg-engaging links pivotally connected to the platform engaging links. Each of the leg engaging links has a rod receiving slot formed therein which includes a channel portion, a ramp portion located proximate one end of the channel portion and a locking opening disposed proximate the ramp portion. A locking rod extends between the platform engaging links with the end portion of the rod being slidably received within the channel portion of the slots formed in the leg engaging links. When the rod ends reside within the locking opening, the platform engaging links and the leg engaging links are locked against relative pivotal movement. However, when the locking rod is lifted slightly, the rod ends move into the channel portion of the slot permitting free pivotal movement of the cooperating links.

With the foregoing in mind, it is an object of the invention to provide a novel folding leg mechanism for use in foldably connecting one or more legs to a support platform which is of simple design, is easy to use and provides positive support to the legs when they are in an extended, platform support position.

Another object of the invention is to provide a mechanism of the aforementioned character in which the folding leg mechanism positively prevents accidental collapse of the legs when the legs are in an extended, platform supporting position.

Another object of the invention is to provide a mechanism of the character described in the preceding paragraphs which prevents binding of the cooperating linkages as the legs which support the platform are moved toward their stowed configuration.

Another object of the invention is to provide a folding leg mechanism which includes a locking member that automatically moves by force of gravity into a locking configuration as the legs which support the platform are moved toward their downward platform support position.

Another object of the invention is to provide a folding leg mechanism which includes a locking member that is moved by a spring member into a locking configuration as the legs are moved into their downward platform support position.

Another object of the invention is to provide a mechanism of the class described which is simple to manufacture and install, is reliable in operation and requires minimum maintenance.

These and other objects of the invention are achieved by the folding leg mechanism illustrated in the drawings and described in the following paragraphs.

BRIEF DESCRIPTION OF THE DRAWINGS

FIG. 7 is a fragmentary, side-elevational view similar to FIG. 6, but showing further movement of the folding leg mechanism toward the locking configuration.

FIG. 8 is a side-elevational view similar to FIG. 5 showing the folding leg mechanism in a fully extended, locked configuration.

FIG. 9 is an enlarged fragmentary view of the area designated in FIG. 8 by the numeral 9.

DESCRIPTION OF THE INVENTION

Figure 1:
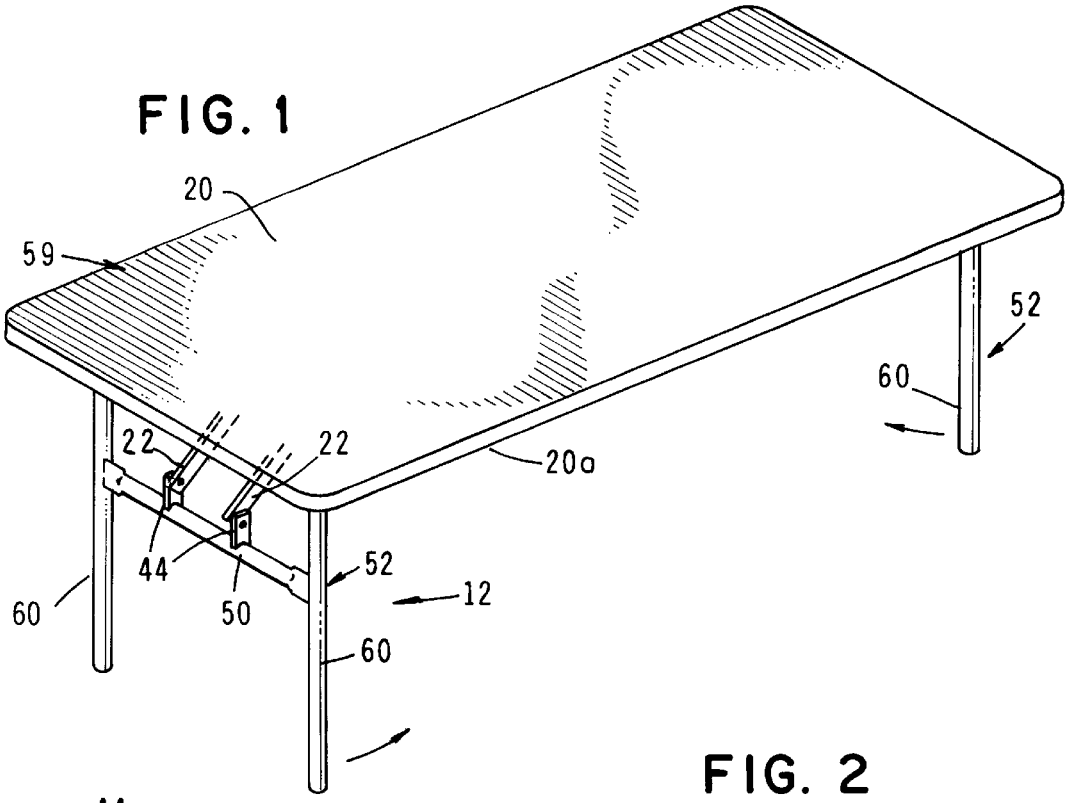
FIG. 1 is a generally perspective view of a table having a top support platform and folding legs interconnected to the support platform by the novel folding leg mechanism of the invention.
Figure 2:
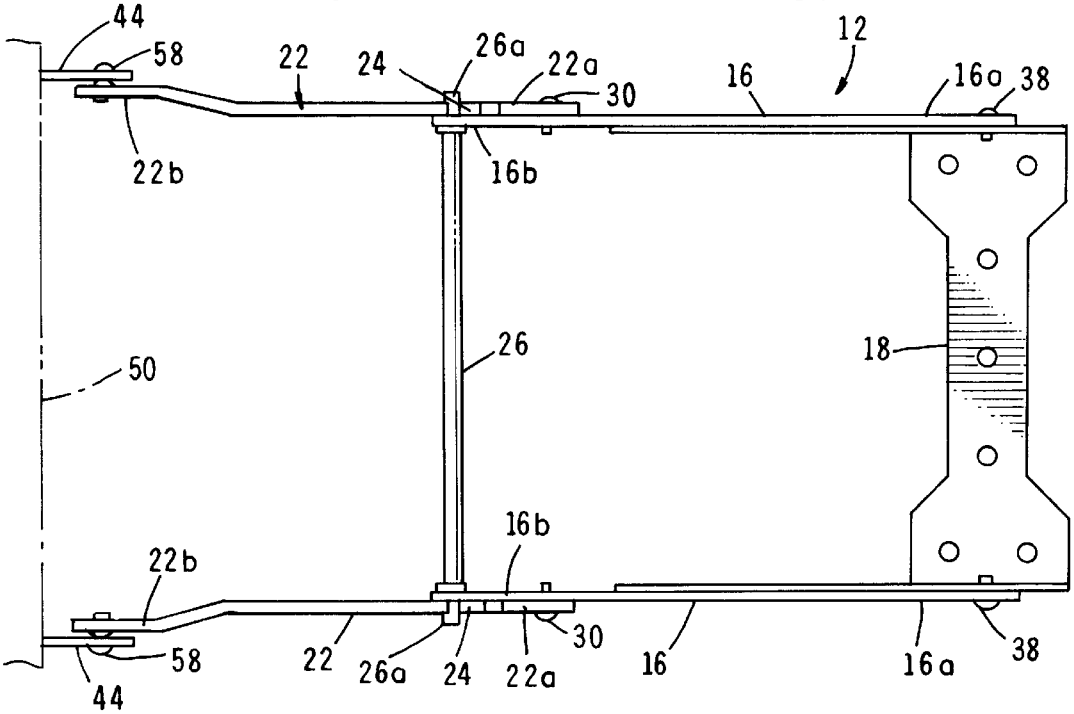
FIG. 2 is a greatly enlarged plan view of one form of the folding leg mechanism of the invention shown in an extended configuration.
Figure 3:
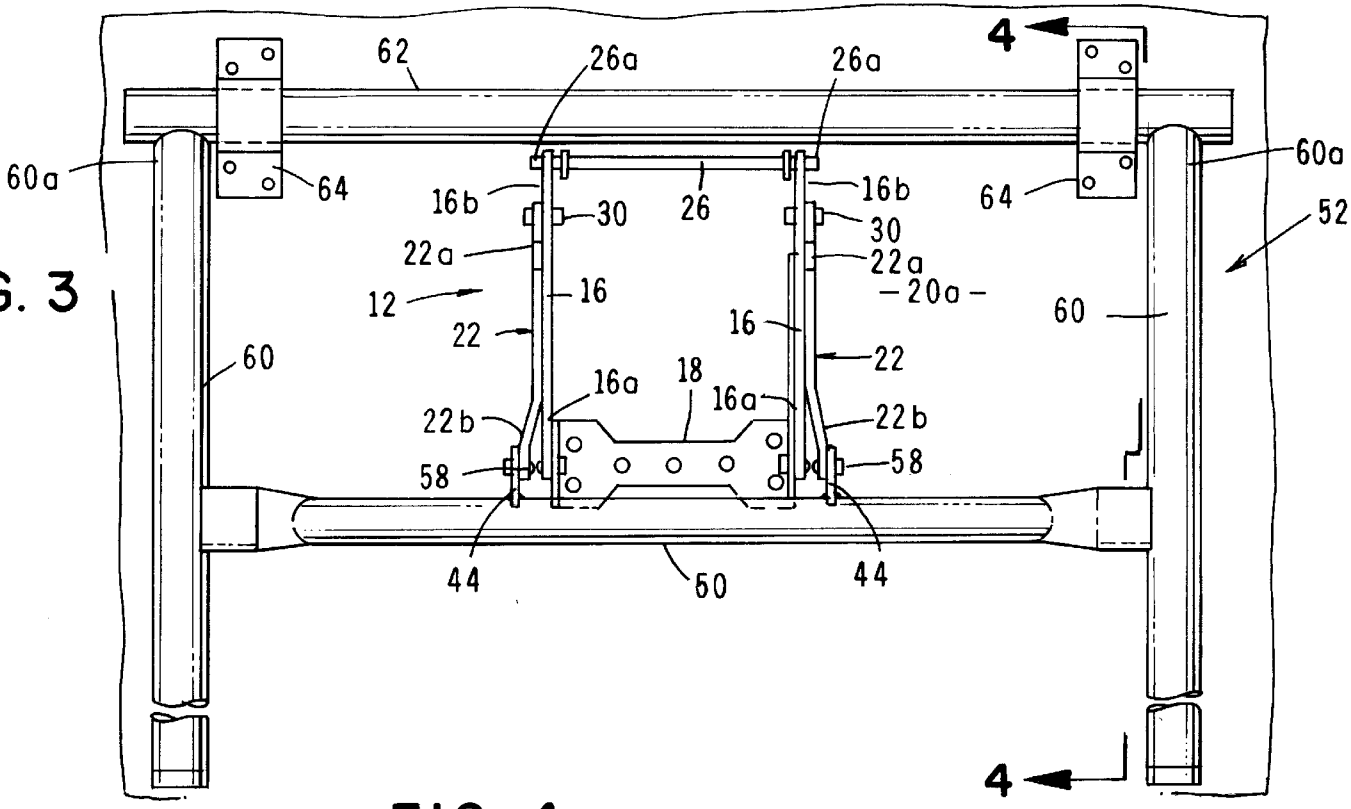
FIG. 3 is a bottom plan view of the folding leg mechanism shown in a folded configuration and shown interconnected with the support platform,of the table and with the folding legs of the table.
Figure 4:
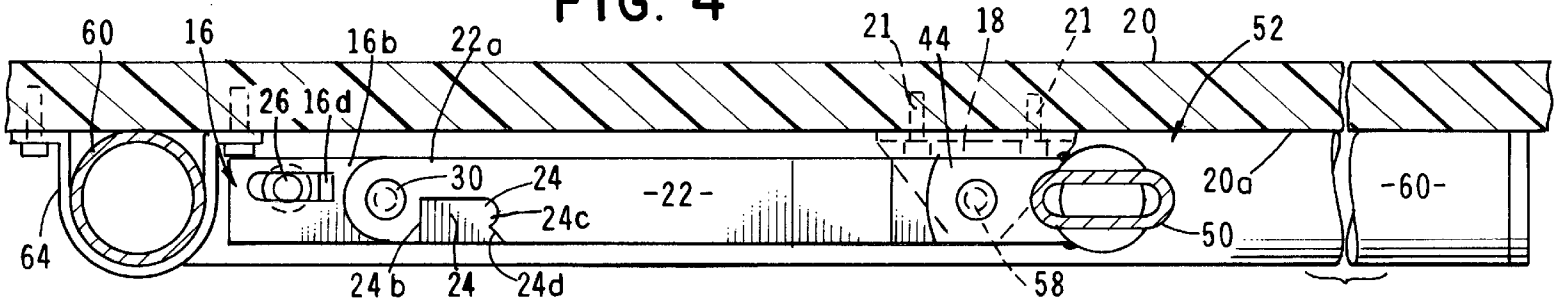
FIG. 4 is a cross-sectional view taken along lines 4—4 of FIG. 3.
Figures 5, 6:
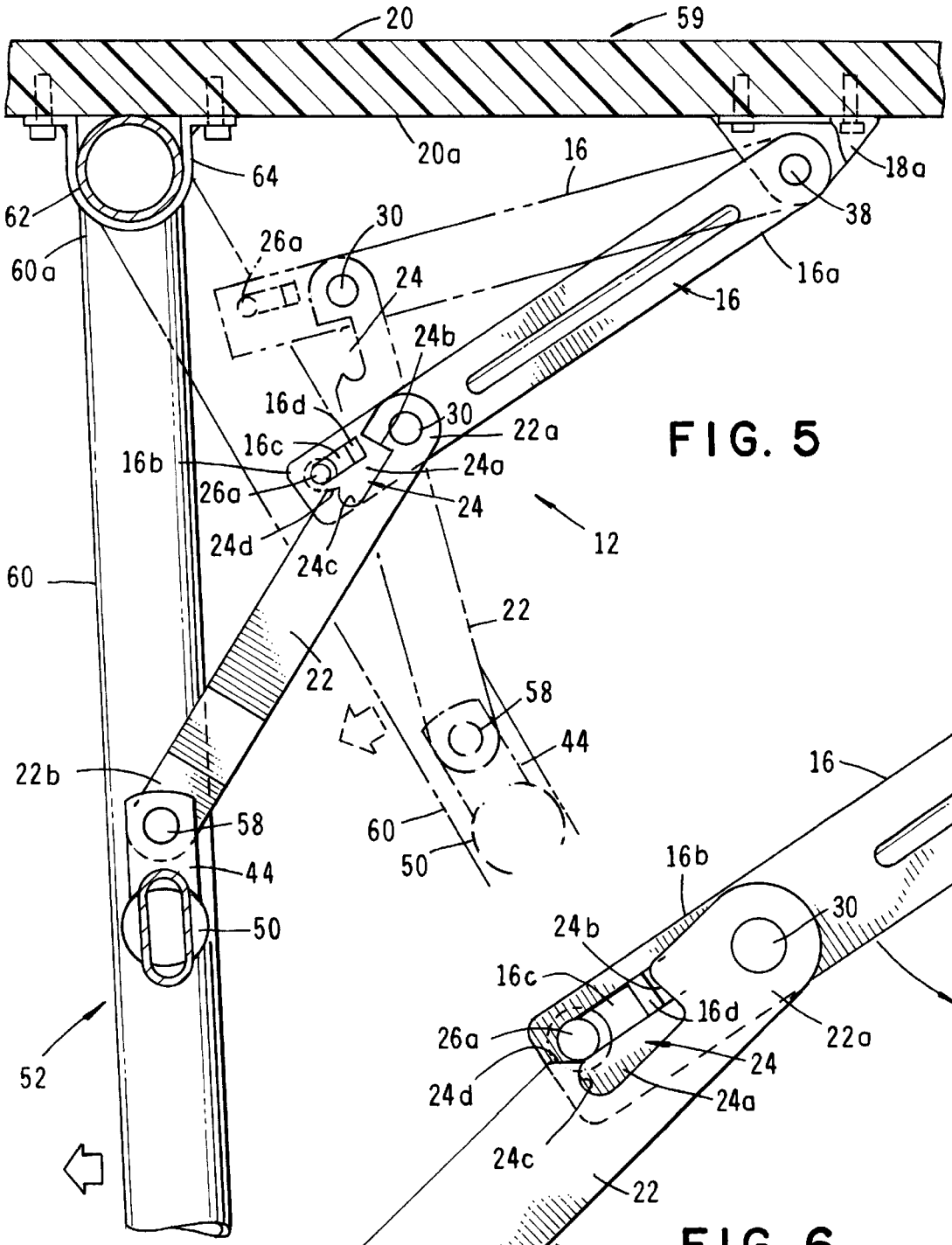
FIG. 5 is a side-elevational view of the folding leg mechanism shown interconnected with the table support platform and with one set of legs thereof, the folding mechanism being shown in a partially folded configuration.
FIG. 6 is an enlarged fragmentary side-elevational view of the locking portion of the folding leg mechanism shown in a position immediately prior to the ends of the locking rod of the folding leg mechanism moving into a locking aperture formed in the leg engaging links of the mechanism.

Referring to the drawings and particularly to FIGS. 1 through 5, one form of the folding leg mechanism of the present invention for use in foldably interconnecting a pair of legs with a support platform is there illustrated and generally designated by the numeral 12. As best seen by referring to FIGS. 2 and 3, the folding leg mechanism of the invention comprises first and second spaced-apart platform engaging links 16. Links 16 are of similar construction and each has a first end 16*a* and a second end 16*b*. Pivotally connected to links 16 proximate ends 16*a* thereof, is a securement means, shown here as a linkage plate 18 which is interconnectable with the lower surface 20*a* of the support platform 20 of the table construction (FIG. 1). Linkage plate 18 can be interconnected with support platform 20 by any suitable means such as threaded connectors or screws 21 (FIG. 4).

Also forming a part of the folding leg mechanism of the invention are first and second leg links 22. Leg links 22 are of similar construction and each includes first and second end portions 22*a* and 22*b* respectively (FIG. 2). As best seen by referring to FIGS. 4 and 5, each leg link 22 is provided proximate end portion 22*a* with a rod receiving slot 24. Rod receiving slots 24 are of a unique configuration and slidably receive the end portions 26*a* of a transversely extending locking rod 26 (FIG. 3). More particularly, each rod receiving slot 24 includes a channel-like portion 24*a* extending between first and second end portions, a shoulder portion 24*b* disposed proximate the second end portion, and an arcuate-shaped locking aperture portion 24*c* disposed proximate the first end portion. Also forming an important aspect of the rod receiving slots 24 is an angled ramp portion 24*d*. The manner of operation of the locking rod 26 will presently be described.

Figures 10, 11:
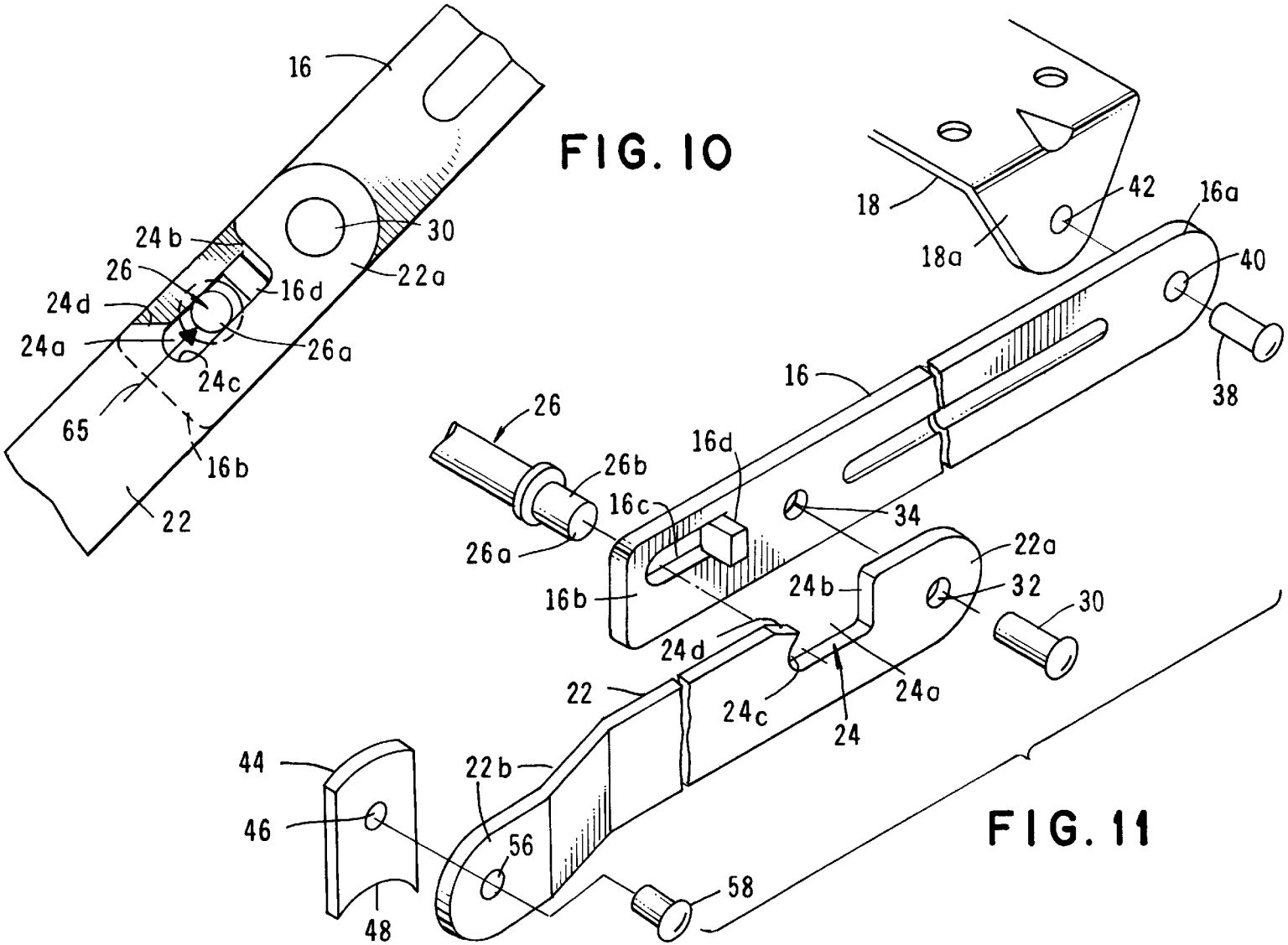
FIG. 10 is a fragmentary side-elevational view similar to FIG. 9, but showing the locking rod portion of the folding leg mechanism being moved into a disengagement or release position.
FIG. 11 is a generally perspective, exploded view of one of the pair of cooperating linkages of the folding leg mechanism and a portion of the support platform engaging bracket of the mechanism.

Links 22 are pivotally interconnected with links 16 by a pivot pin 30 which extends through an aperture 32 provided in end portion 22*a* of link 22 and through an aperture 34 provided in link 16 proximate end 16*b* thereof (FIG. 11). Similarly, link 16 is interconnected with the securement means or plate 18 by a pivot pin 38 which is receivable through an aperture 40 provided in link 16 proximate end 16*a*. Pin 38 also extends through an aperture 42 provided in a downwardly extending leg portion 18*a* formed on plate 18. Pivotally connected proximate each end 22*b* of links 22 is leg connector means shown here as a connector member 44. Connector member 44 includes an intermediate portion provided with an aperture 46 and a lower arcuately shaped portion 48 which is connected as by welding to a transversely extending member 50 which forms a part of one of the leg assemblies 52 of the folding table shown in FIG. 1. Receivable through aperture 46 and through an aperture 56 formed in end 22*b* of leg 22 is a locking pin 58 (FIG. 11).

As best seen by referring to FIGS. 1 and 3, leg assembly 52 of the worktable 59 of one form of the present invention comprises, in addition to transversely extending member 50, a pair of downwardly extending legs 60. Legs 60 are interconnected by any suitable means such as welding with transversely extending member 50 in the manner shown in FIGS. 1 and 3. Also forming a part of each leg assembly 52 is a transversely extending upper rod-like member 62 to which the upper ends 60*a* of leg 60 are interconnected by any suitable means such as welding. Each of the members 62 of the leg assembly is pivotally interconnected with lower surface 20*a* of the support platform of the worktable by bearing-like brackets 64. Brackets 64 which are generally U-shaped are constructed so as to permit folding movement of the leg assemblies from the downward operable position shown in FIG. 1 to the stowed, or folded, position shown in FIG. 3 (see also FIGS. 5 and 8).

As best seen by referring to FIGS. 3 and 11, platform leg 16 is provided with an elongated slot 16*c* which receives portions 26*b* of locking rod 26 (FIG. 11) for slidable movement therewithin between a first locking position and a second disengagement position. Also provided on platform engaging link 16 is an outwardly extending finger-like portion 16*d* which is received within slot 24 formed in leg length 22. When the linkages are in the extended position shown in FIG. 8, finger 16*d* resides in close proximity with shoulder 24*b* of slot 24 and acts as a stop to prevent over travel of the links and thereby preclude rod 26 from binding in slot 24 due to the overcenter of the two links.

Turning to FIGS. 5 through 9, the operation of the worktable 59 and of the folding leg mechanism of the present form of the invention is there illustrated. As indicated by the phantom lines in FIG. 5, when links 16 and 22 are in a substantially perpendicular relationship, the legs 60 of the table leg assembly are being moved from the stowed configuration to an intermediate position. During movement of the legs and the link elements 16 and 22, the ends 26*a* of locking rod 26 are disposed within a guide slot 16*c* formed in link 16. As the table legs 60 are moved toward a vertical position, links 16 and 22 move toward an aligned position in a manner shown in FIG. 5. As the links 16 and 22 move toward an aligned position, it is to be noted that rod ends 26*a* move toward ramp portion 24*d* of link 22. Continued movement of the links 16 and 22 toward the position shown in FIG. 6 will cause the ends 26*a* of rod 26 to move into engagement with ramp 24*d* which tends to lift the rod slightly so that it can ride over ramp 24*d* and move toward a mating engagement with arcuate shaped portion 24*c* of link 22 in the manner shown in FIG. 7. As indicated in FIG. 9, when the ends 26*a* of rod 26 clear the end of ramp 24*d*, the rod assembly will fall by force of gravity causing ends 26*a* of rod 26 to fall into mating locking engagement with arcuate portion 24*c* of slot 24 (see also FIG. 8) wherein legs 60 are in a substantially vertical orientation and extend substantially perpendicularly from support platform 20. With ends 26*a* of locking rod 26, lockably positioned within arcuate portion 24*c* of slot 24, folding of links 16 relative to links 22 will be positively prevented by locking rod 26.

Turning to FIG. 10, it can be seen that, when it is desired to fold table legs 60 of the worktable 59 into their stowed configuration, an upward force exerted on rod 26 in the direction of the arrow 65 of FIG. 10 will move rod ends 26*a* out of locking engagement with portion 24*c* of slot 24 so as to once more permit relative pivotal movement of lengths 16 and 22 about pivot pin 30. Continued force on rod 26 will also move the cooperating links to move into a non-aligned position permitting the legs to fold.

Turning next to FIGS. 12 through 23, an alternate form of the folding leg mechanism of the invention is there illustrated and generally designated by the numeral 72. Mechanism 72 is substantially identical to the earlier described mechanism 12, save that biasing means is provided to urge the locking rod into a locking position. Because of this substantial similarity, like numerals are used in FIGS. 12 through 23 to identify like components. As best seen by referring to FIGS. 12 and 13, the folding leg mechanism of this alternate form of the invention comprises first and second spaced-apart platform links 16, securement means in the form of a linkage plate 18 pivotally connected thereto and a pair of first and second leg links 22 which are pivotally connected to platform links 16.

Figure 12:
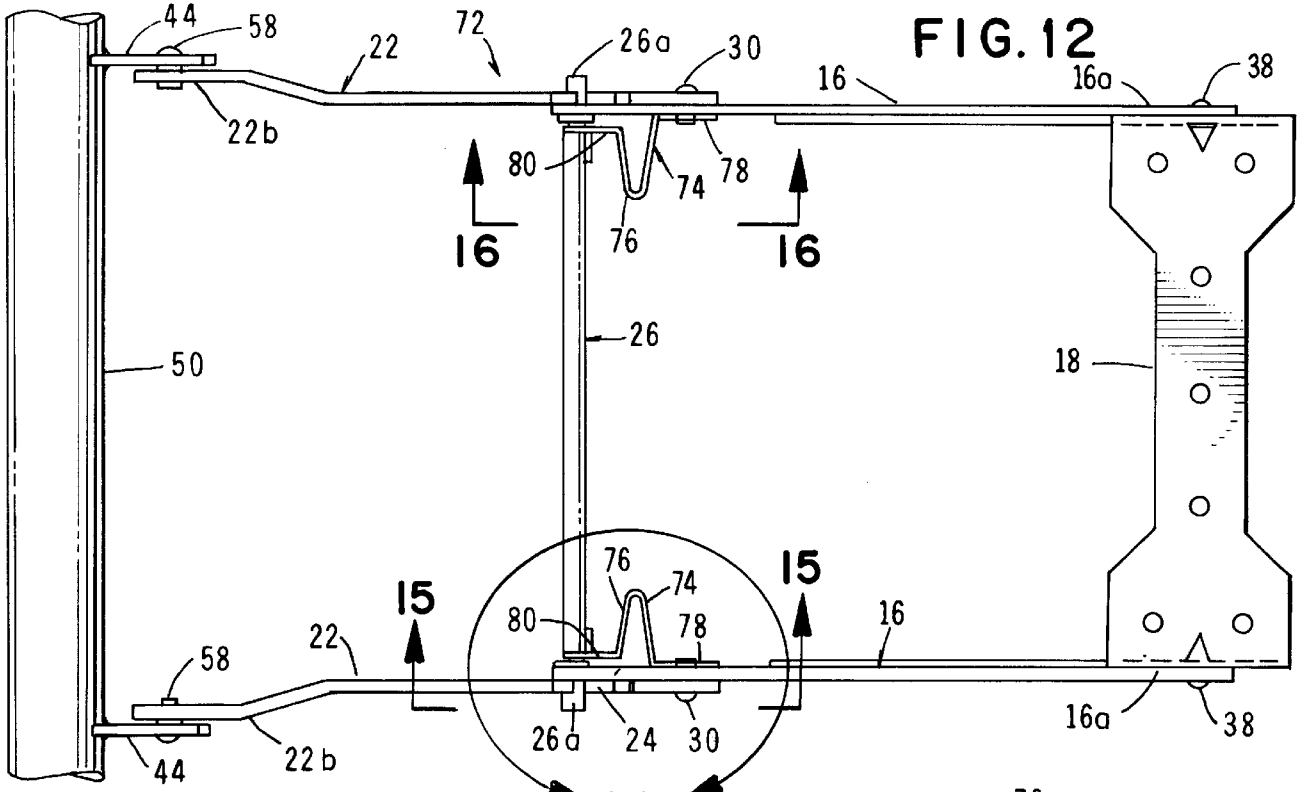
FIG. 12 is a greatly enlarged plan view of an alternate form of the folding leg mechanism of the invention shown in an extended configuration.

Identical rod receiving slots 24 are formed in each of the leg links 22 and slidably receive the end portions 26*a* and 26*b* of an identical, transversely extending locking rod 26 (FIG. 12). As before, each rod receiving slot 24 includes a channel-like portion 24*a*, a shoulder portion 24*b* and an arcuate-shaped locking aperture portion 24*c*. Also forming an important aspect of the rod receiving slot design is the previously mentioned angled ramp portion 24*d*.

Figure 14:
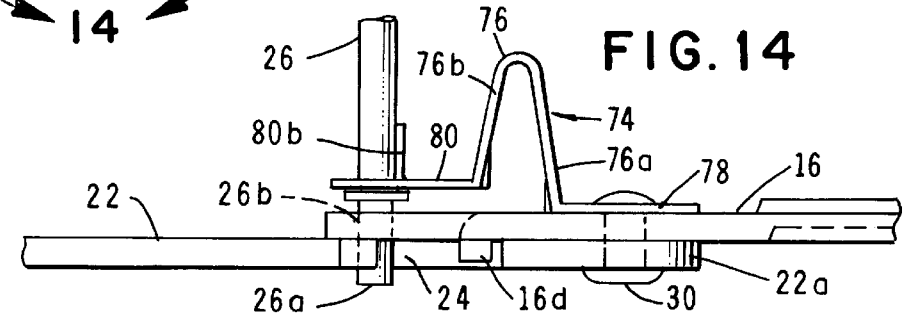
FIG. 14 is an enlarged view of the area identified in FIG. 12 as "14".
Figure 13:
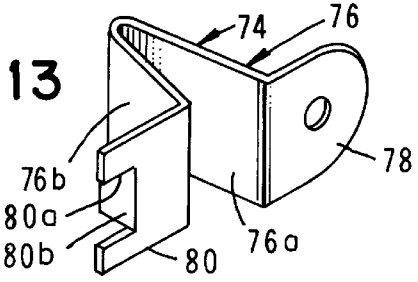
FIG. 13 is a generally perspective view of one of the spring members of the mechanism for urging against movement of the locking rod toward a disengaged position.
Figure 16:
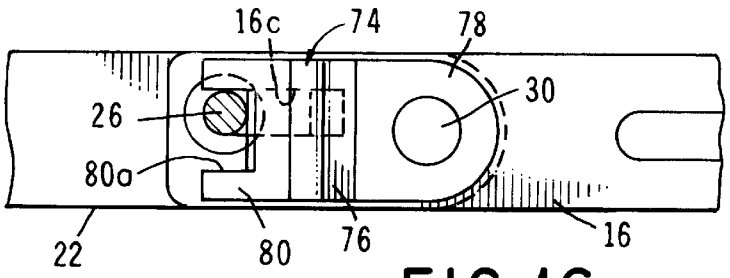
FIG. 16 is an enlarged view taken along lines 16—16 of FIG. 12.
Figure 15:
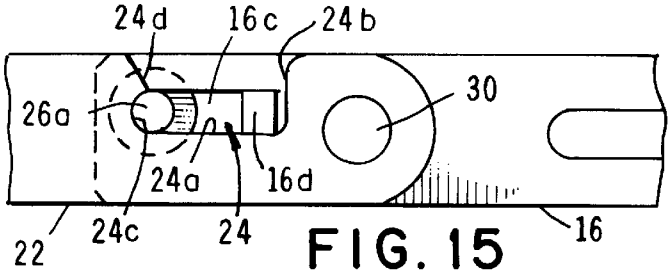
FIG. 15 is a view taken along lines 15—15 of FIG. 12.
Figure 23:
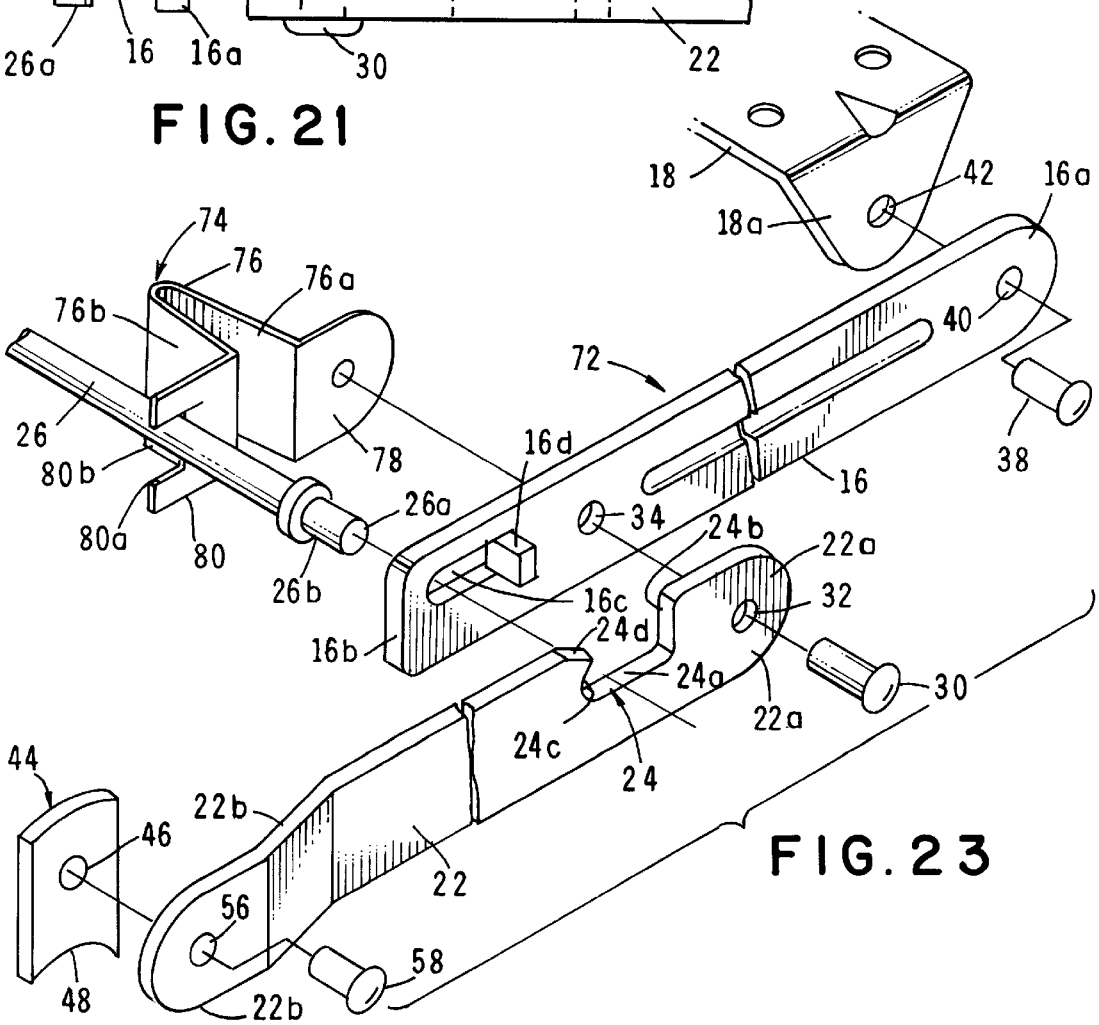
FIG. 23 is a generally perspective, exploded view of one of the pair of cooperation linkages of the folding leg mechanism of this latest form of the invention along with a platform engaging bracket of the mechanism.

The operation of the locking rod 26 of mechanism 72 is similar to that previously described, but in this latest embodiment, biasing means in the form of spring members 74 comprise a part of the linkage assembly and function to yieldably urge the rod member of the assembly and into the extended configuration shown in FIG. 12. As best seen in FIGS. 12, 13, and 23, each of the spring members 74 comprises a generally "V" shaped body portion 76 having angularly extending, resiliently deformable legs 76*a* and 76*b* which terminate in integrally formed feet 78 and 80. As shown in FIGS. 12 and 14, feet 78 are connected to links 16 by connectors 30 while feet 80, each of which is provided with a U-shaped slot 80*a* and a tongue 80*b*, reside in pushing engagement with rod 26.

Figure 22:
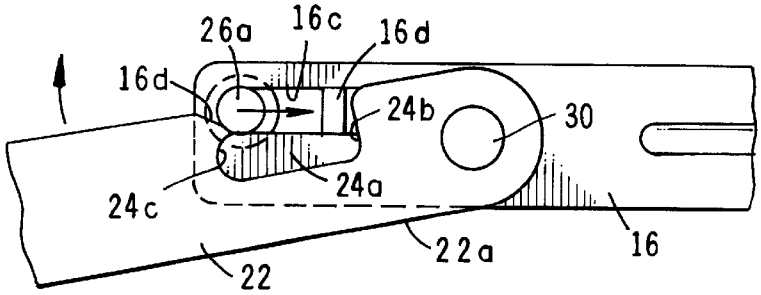
FIG. 22 is a view similar to FIG. 19 but showing the locking mechanism being moved toward a locking configuration within the locking apertures formed in the leg links.
Figure 21:
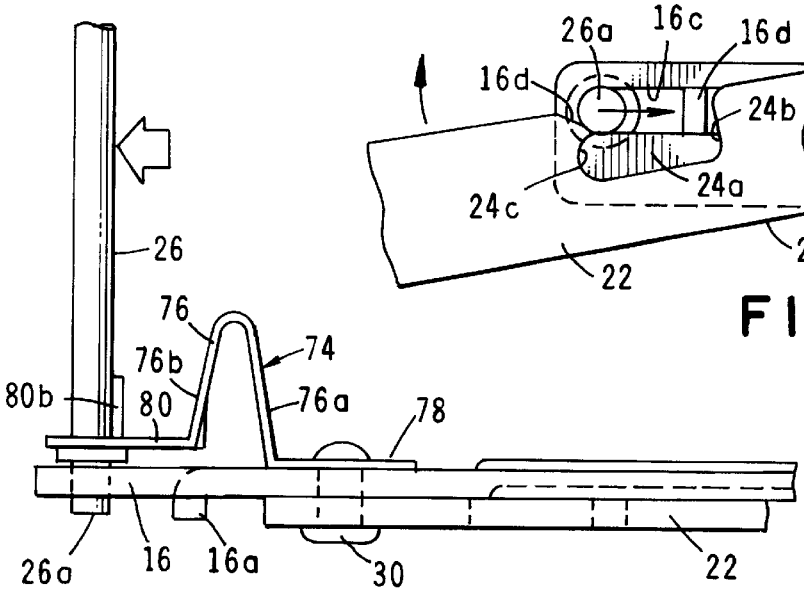
FIG. 21 is a top, fragmentary view showing the spring member in an extended configuration with the locking rod moved into a fully extended position by the spring.

Turning particularly to FIGS. 12 and 17 through 22, operation of the folding leg mechanism of this latest form of the invention is there illustrated. As shown in FIG. 12, when the legs of the table 59 are in a substantially perpendicular relationship with the top or support surface of the table, the folding leg mechanism is in the extended configuration shown in FIG. 12. As before, during movement of the legs toward their extended operable position, the ends 26*b* of locking rod 26 are disposed within the guide slots 16*c* formed in links 16. However, as the table legs 60 are moved toward their downward, operable position, links 16 and 22 move toward their aligned position shown in FIG. 12. Immediately prior to reaching this position, rod ends 26*a* move toward ramp portion 24*d* of link 22. As shown in FIG. 22, continued movement of the links 16 and 22 toward the locked position will cause the ends 26*a* of rod 26 to move into engagement with ramp 24*d* which tends to lift the rod slightly against the urging of the biasing means or spring member 74 so that it can ride over ramp 24*d* and move toward arcuate-shaped portion 24*c* of link 22. During this movement toward the locking position, legs 76*a* and 76*b* will be yieldably deformed inwardly. When the ends 26*a* of rod 26 clear the end of ramp 24*d*, the rod will be urged by the return force of the spring into seating engagement with arcuate portions 24*c* of slots 24 (see also FIGS. 14, 15, and 16) wherein the table legs are in a substantially vertical orientation and extend substantially perpendicularly from support platform. With ends 26*a* of locking rod 26 held securely in position within arcuate portion 24*c* of slot 24 by the force of springs 70, accidental folding of links 16 relative to links 22 will be positively prevented by locking rod 26.

Figure 18:
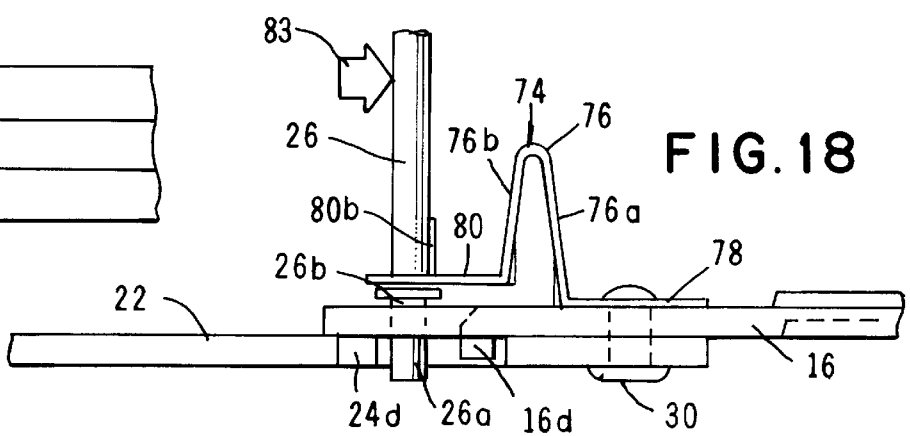
FIG. 18 a side-elevational view similar to FIG. 14 showing the locking rod being moved toward the release position against the urging of one of the spring members as shown in FIG. 17.
Figure 17:
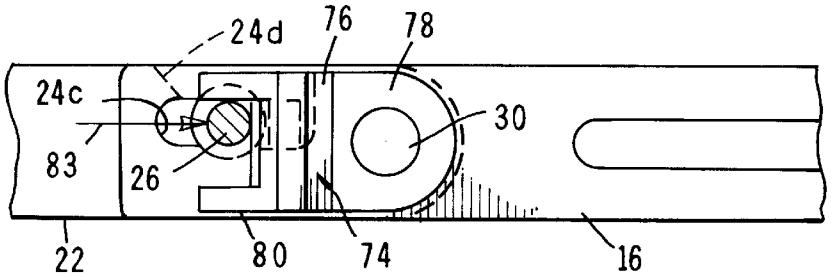
FIG. 17 is a view similar to FIG. 16, but shown movement of the locking rod of the mechanism toward the release configuration.
Figure 20:
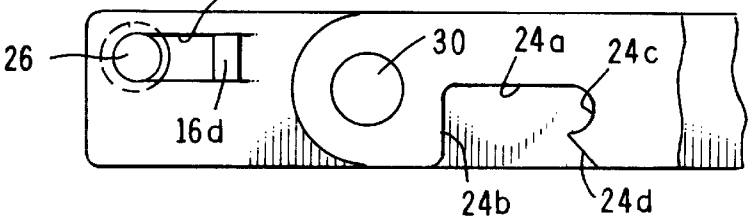
FIG. 20 is a view similar to FIG. 19 but showing the locking rod in a fully extended position as a result of the urging of the spring member.
Figure 19:
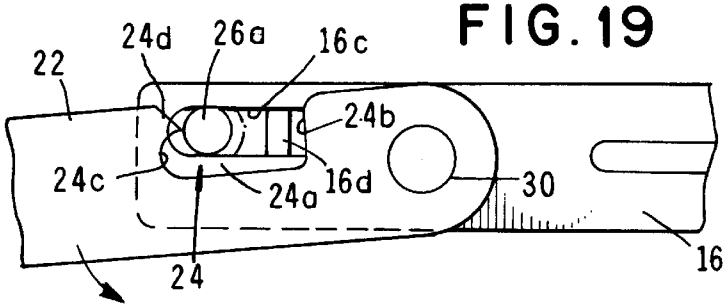
FIG. 19 is an enlarged, fragmentary, side-elevational view of the locking portion of the folding leg mechanism shown in an intermediate position wherein the folding leg mechanism is starting to move into the folded configuration with the locking rod moving out of the locking aperture.

Turning next to FIGS. 17 and 18, when it is desired to fold table legs into their stowed configuration, a force exerted on rod 26 in the direction of the arrow 83, of FIGS. 17 and 18, will yieldably deform spring leg 76*a* and 76*b* in the manner shown in FIG. 18 to move rod ends 26*a* away from locking portions 24*c* of slots 24 and into channel portions 24*a*. This movement of the rod ends will permit relative pivotal movement of links 16 and 22 about pivot pin 30 in the manner shown in FIG. 19. Continued movement of the table legs toward the stowed configuration will cause the cooperating links 16 and 22 to move into the orientation shown in FIGS. 20 and 21.

Figure 24:
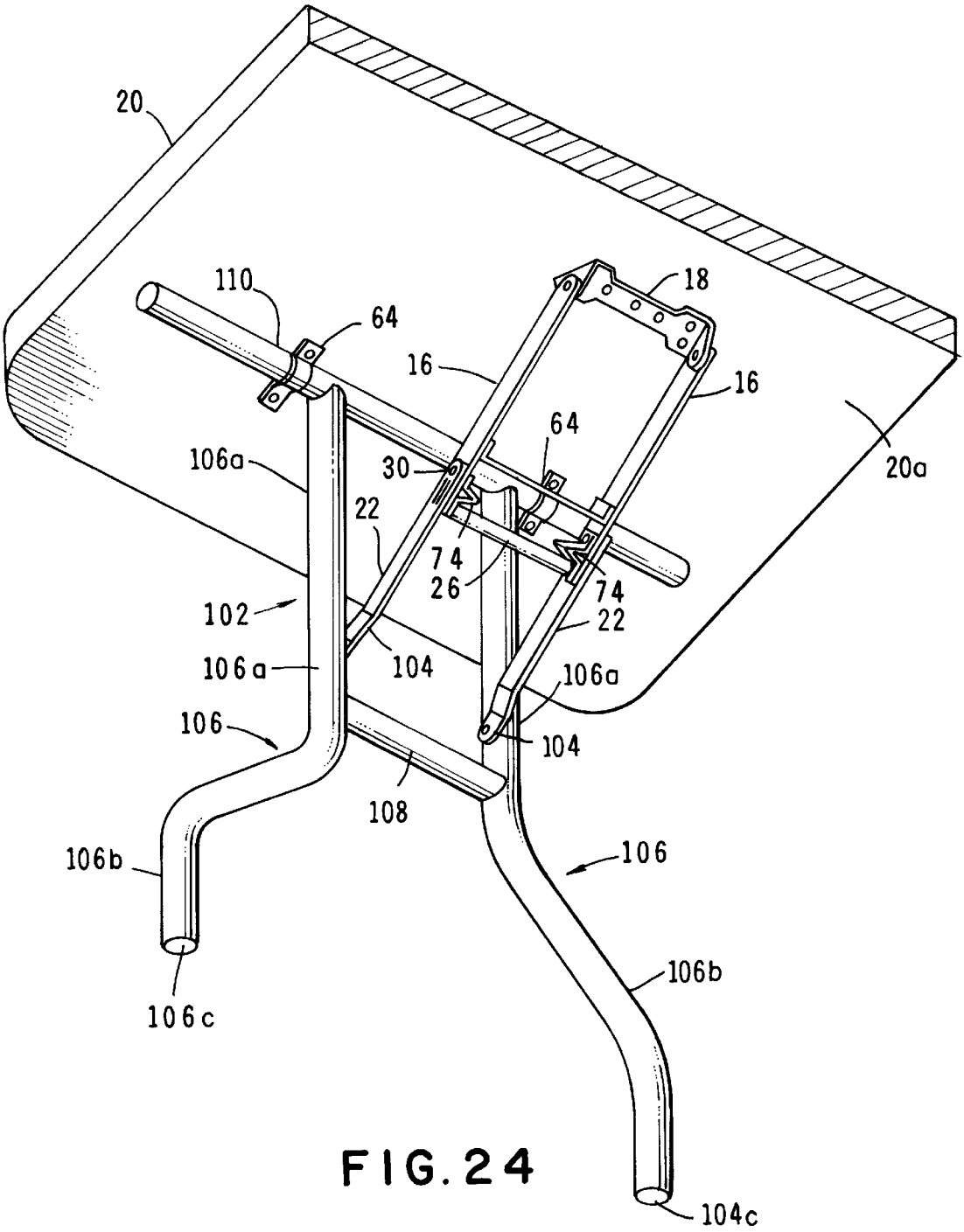
FIG. 24 is a generally perspective bottom view of an alternate form of the table construction of the invention which embodies a different type of support leg assembly.
Figure 25:
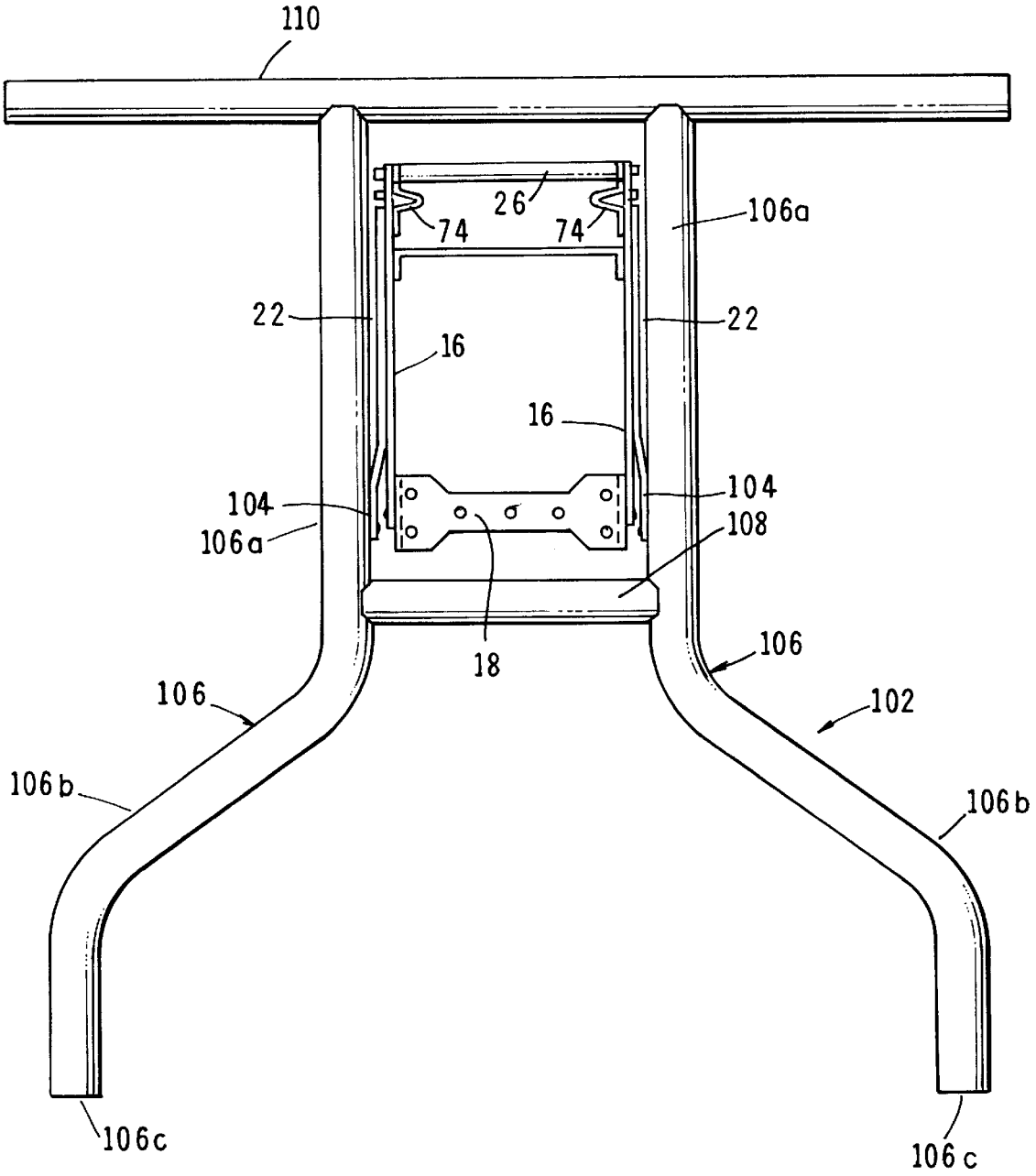
FIG. 25 is an end view of the leg assembly and the folding leg mechanism of this alternate table construction.

Turning next to FIGS. 24 and 25, an alternate form of the table construction of the present invention is there illustrated and generally designated by the numeral 102. This alternate embodiment is quite similar to the table construction shown in FIGS. 1 through 23 and like numerals are used in FIGS. 24 and 25 to identify like components. For example, the folding leg mechanism of this latest form of the invention is identical to that previously described and comprises first and second space-apart platform engaging links 16. Pivotally connected to links 16 proximate the ends thereof, is a securement means, shown as the previously described linkage plate 18 which is interconnectable with the lower surface 20*a* of the support platform 20 of the table construction (FIG. 24).

Since the folding leg mechanism of this alternate embodiment of the invention is substantially identical in construction and operation to that previously described, the details of this mechanism will not be further discussed. However, it should be noted that, due to the different leg construction, the ends 104 of links 22 are pivotally connected directly to leg portions 106*a* of legs 106 of the leg construction by any suitable means (FIG. 24).

Legs 106 also include lower leg portions 106*b* which are further spaced than leg portions 106*a* and terminate in ground engaging extremities 106*c*. Legs 106 are interconnected by any suitable means such as welding with a transversely extending member 108 in the manner shown in the drawings. Also forming a part of each leg assembly is a transversely extending upper rod-like member 110 to which upper portions 106*a* are interconnected by any suitable means such as welding. As before, each of the leg assemblies is pivotally interconnected with lower surface 20*a* of the support platform of the worktable by bearing-like brackets 64 (FIG. 24).

As previously mentioned, folding of the leg assemblies of this last form of the invention is accomplished in the same manner as the folding of leg assemblies 52 through use of the novel folding leg mechanism of the invention.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A folding leg mechanism for use in foldably interconnecting a pair of legs with a support platform comprising:

(a) first and second spaced apart platform links, each said platform link having first and second ends;

(b) securement means connected to said first and second platform links proximate said first ends thereof for pivotally interconnecting said platform links with the support platform;

(c) first and second, spaced-apart leg links connected to the pair of legs, said first and second leg links also being pivotally interconnected with said first and second platform links respectively, each said leg link having first and second ends and a rod receiving slot formed therein intermediate said first and second ends, each said rod receiving slot having first and second ends and comprising:

(i) a ramp portion disposed proximate said first end; and (ii) a rod retaining portion disposed proximate said second end; and (d) a rod assembly connected to said platform links proximate said second ends thereof, said rod assembly including an elongated rod having end portions slidably receivable within said rod receiving slots of said leg links.

2. A mechanism as defined in claim 1 further including connector means connected to said leg links for pivotally interconnecting said leg links with the pair of legs.

3. A mechanism as defined in claim 2 in which each of said platform-engaging links is provided with a guide slot for slidably receiving said end portions of said elongated rod.

4. A mechanism as defined in claim 2 in which each said rod receiving slot comprises:

(a) a shoulder portion disposed proximate said second end of said slot; and (b) a guide channel extending between said ramp portion and said shoulder portion, said guide channel terminating at one end in said rod retaining portion.

5. A mechanism as defined in claim 4 further including biasing means connected to said platform links for urging said rod assembly toward said rod retaining portion of said rod receiving slot.

6. A folding leg mechanism for use in foldably interconnecting a pair of legs with a support platform comprising:

(a) first and second spaced apart platform links, each said platform link including first and second ends and having a guide slot formed therein intermediate said first and second ends;

(b) a linkage plate pivotally connected to said first and second platform links proximate said first ends thereof, said linkage plate being interconnectable with the support platform;

(c) first and second, spaced-apart leg links connected to the pair of legs, said first and second leg links also being pivotally interconnected with said first and second platform links respectively, each said leg link having first and second ends and a rod receiving slot formed therein intermediate said first and second ends, each said rod receiving slot having first and second ends and comprising:

(i) a ramp portion disposed proximate said first end of said rod receiving slot; and (ii) a rod retaining portion disposed proximate said second end of said rod receiving slot; and (d) a rod assembly spanning said platform links proximate said second ends thereof, said rod assembly including an elongated rod having end portions slidably receivable within said guide slot of said platform links and also being receivable within said rod receiving slot of said leg links.

7. A mechanism as defined in claim 6 further including connector means for pivotally interconnecting said leg links with the pair of legs.

8. A mechanism as defined in claim 7 in which connector means comprises connector links pivotally connected to said leg links proximate said second ends thereof.

9. A mechanism as defined in claim 7 in which each said rod receiving slot formed in said leg links comprises:

(a) a shoulder portion disposed proximate said second end of said rod receiving slot; and (b) a guide channel extending between said ramp portion and said shoulder portion, said guide channel terminating at one end in said rod retaining portion.

10. A mechanism as defined in claim 9 in which said rod retaining portion of said slot formed in said leg links is generally semicircular in shape.

11. A mechanism as defined in claim 10 further including biasing means connected to said platform links for urging said end portions of said rod into said rod retaining portion of said slots formed in said leg links.

12. A mechanism as defined in claim 11 in which said biasing means comprises at least one yieldably, deformable, generally "V" shaped spring member.

13. A mechanism as defined in claim 12 in which said spring member comprises a body portion have angularly extending, resiliently deformable legs each terminating in a integral foot portion.

14. A mechanism as defined in claim 13 in which one of said integral foot portions is connected to said platform links and in which the other of said integral foot portions is in engagement with said rod.

15. A worktable comprising:

(a) a support platform;

(b) a leg assembly pivotally connected to said support platform for movement between an operable position and a stowed position; and (c) a mechanism interconnecting said leg assembly with said support platform, said mechanism comprising:

(i) first and second spaced apart platform links, each said platform link including first and second ends and having a guide slot formed therein intermediate said first and second ends;

(ii) securement means connected to said first and second platform links proximate said first ends thereof for pivotally interconnecting said platform links with said support platform;

(iii) first and second, spaced-apart leg links connected to the pair of legs, said first and second leg links also being pivotally interconnected with said first and second platform links respectively, each said leg link having first and second ends and a rod receiving slot formed therein intermediate said first and second ends, each said rod receiving slot having first and second ends and comprising:

a. a ramp portion disposed proximate said first end of said rod receiving slot; and b. a rod retaining portion disposed proximate said second end of said rod receiving slot; and (iv) a rod assembly connected to and spanning said support links proximate said second ends thereof, said rod assembly including an elongated rod having end portions receivable within said rod receiving slots formed in said leg links.

16. A mechanism as defined in claim 15 further including connector means connected to said leg links for pivotally interconnecting said leg links with said leg assembly.

17. A mechanism as defined in claim 15 in which said rod receiving slot comprises:

(a) a shoulder portion disposed proximate said second end of said rod receiving slot; and (b) a guide channel extending between said ramp portion and said shoulder portion of said rod receiving slot, said guide channel terminating at one end in said rod retaining portion.

18. A mechanism as defined in claim 15 further including biasing means carried by said platform links for urging said rod assembly toward said rod retaining portion of said slots formed in said leg links.

19. A mechanism as defined in claim 18 in which said biasing means comprises at least one yieldably deformable, generally "V" shaped spring member.

20. A mechanism as defined in claim 19 in which said spring member comprises a body portion having angularly extending, resiliently deformable legs, each said leg terminating in an integral foot portion.

* * * * *